US006734829B1

(12) United States Patent
Göttl

(10) Patent No.: US 6,734,829 B1
(45) Date of Patent: May 11, 2004

(54) ANTENNA

(75) Inventor: Max Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/019,934

(22) PCT Filed: Jun. 7, 2000

(86) PCT No.: PCT/EP00/06411

§ 371 (c)(1),
(2), (4) Date: Jan. 18, 2002

(87) PCT Pub. No.: WO01/04991

PCT Pub. Date: Jan. 18, 2001

(30) Foreign Application Priority Data

Jul. 8, 1999 (DE) ..... 199 31 907

(51) Int. Cl.[7] ..... H01Q 21/12
(52) U.S. Cl. ..... 343/815; 343/797; 343/816
(58) Field of Search ..... 343/793, 797, 343/798, 810, 812, 813, 815, 816, 817, 818, 819

(56) References Cited

U.S. PATENT DOCUMENTS 3,541,559 A 11/1970 Evans
4,812,855 A * 3/1989 Coe et al. ..... 343/818
6,025,812 A * 2/2000 Gabriel et al. ..... 343/797
6,028,563 A * 2/2000 Higgins ..... 343/797

FOREIGN PATENT DOCUMENTS

| | | |
|---|---|---|
| DE | 42 19 168 A1 | 12/1993 |
| DE | 196 27 015 A1 | 1/1998 |
| DE | 198 21 223 A1 | 11/1998 |
| DE | 198 29 714 A1 | 1/1999 |
| EP | 0 685 900 A1 | 12/1995 |
| GB | 2 171 257 A | 8/1986 |
| WO | 98/01923 | 1/1998 |

* cited by examiner

*Primary Examiner*—Don Wong
*Assistant Examiner*—Shih-Chao Chen
(74) *Attorney, Agent, or Firm*—Nixon & Vanderhye P.C.

(57) ABSTRACT

An antenna comprises at least two or more radiators such as, especially dual-polarized radiators, and at least one additional passive conducting decoupling elements. The decoupling element, in its longest direction of extension, or at least one component of the decoupling element, with its longest direction of extension, extends in the propagation direction of the electromagnetic waves and/or perpendicular to the plane of the reflector.

27 Claims, 11 Drawing Sheets

ANTENNA

This application is the US national phase of international application PCT/GB00/06411, filed Jun. 7, 2000, which designated the US.

The invention relates to an antenna having at least two fed radiating elements as claimed in the precharacterizing clause of claim 1.

As is known, in the case of antennas having at least two fed radiating elements, that is to say having a number of fed radiating elements, it is important to achieve as much decoupling as possible between the different radiating elements. Particularly in the case of dual-polarized radiating elements or arrays, a high level of decoupling is desirable between the radiating elements for one polarization and the radiating elements for the other polarization, which is at right angles to it. Such arrays may comprise, for example, a number of elements in the form of dipoles, slots or planar radiating elements, such as those which are known, for example, from EP 0 685 900 A1 or from the prior publication "Antennen" [Antennas], Part 2, Bibliographical Institute in Mannheim/Vienna/Zurich, 1970, pages 47 to 50. This document describes, for example, omnidirectional radiating elements with horizontal polarization in the form of a dipole square or a cruciform dipole, in which coupling exists between the two systems which are physically offset through 90°.

In order to increase the directionality, such radiating elements are normally arranged in front of a reflector. A disadvantage that has been found in this case is that the intrinsically good decoupling in particular between radiating elements with orthogonal polarizations is made worse by arranging them as an array, in particular due to the influences of the reflector.

appropriate decoupling elements have already been proposed in order to compensate for these disadvantages mentioned above.

The previously published DE 196 27 015 A1 has already proposed that decoupling devices in the form of strips or crosses be arranged between the radiating elements, in which case, particularly when using strips, these strips are arranged along the connecting line of two antenna devices, which are arranged offset with respect to one another, in an antenna array. In contrast to already known solutions relating to this, these strips are not arranged transversely with respect to the connection direction between two antenna arrangements, but parallel to the connecting line between two adjacent antenna devices.

The previously published DE 198 21 223 A1 proposes that passive strip arrangements be used as decoupling elements, which are provided such that they are aligned running centrally between in each case two antenna devices, which are arranged offset like an antenna array, between these antenna devices in the transverse direction with respect to the direction in which the radiating elements are fitted, or else are arranged parallel to the direction in which the radiating elements are fitted, and to the side of said radiating elements at the same time. To this extent, this arrangement corresponds to that already proposed in the previously published U.S. Pat. No. 3,541,559, which likewise proposes that the individual decoupling elements be arranged to the side of the individual antennas, like a frame.

Furthermore, GB 2 171 257 A discloses an antenna array which has a number of dipoles arranged vertically one above the other, with a projecting element in each case being arranged above two dipoles which are arranged one above the other, with the aim of improving the decoupling between the dipoles. This antenna array, which is already known from this document, is, in fact, constructed using stripline technology.

The object of the present invention, in the case of antennas having at least two fed radiating elements, in particular in the case of antenna arrays and at the same time in particular in the case of dual-polarized antenna arrays, is to allow a further improved capability for decoupling between the various radiating elements.

According to the invention, the object is achieved by the features specified in claim 1.

Advantageous refinements of the invention are specified in the dependent claims.

It must be regarded as being extremely surprising that, in complete contrast to all the previously published prior art, it is now proposed that conductive decoupling elements be used, with their main extent direction, that is to say with their longest extent in the propagation direction of the electromagnetic wave and/or with their longest extent, being aligned at right angles to a reflector. In this case, the alignment need not correspond exactly to the propagation direction of the electromagnetic wave, and do not correspond exactly to the perpendicular to the plane of a reflector. All that is necessary according to the invention is for the decoupling elements, which are preferably in the form of rods, to be aligned with a component in the propagation direction of the electromagnetic waves, that is to say in particular running at right angles to the plane of the reflector plate, with at least these components representing a greater value than a component at right angles thereto. If the decoupling elements are configured in the form of rods, this means, in other words, that the angle between the longitudinal extent of the decoupling elements and a perpendicular to the reflector plate plane (that is to say to the propagation direction of the electromagnetic waves) is less than 45°.

The system according to the invention—and this is particularly surprising—has critically significant advantages particularly in the case of dual-polarized antennas, which hence comprise, in particular, at least one cruciform dipole or at least one dipole square. In contrast, the coupling elements which are known from GB 2 171 257 A relate only to a dipole arrangement with one polarization, which are also adjacent.

Thus, according to the invention, two mutually perpendicular polarizations are preferably in each case affected, in which no radiating elements located vertically alongside one another, and which could be decoupled, are provided. A further difference to the prior art is that, in the case of dual-polarized antennas, two separate inputs are used, between which the decoupling (or isolation) must be measurable, while, in the case of the improved decoupling with a deeper arrangement with only one polarization, such decoupling is not measurable (as, in fact, there is only one input).

As mentioned, the decoupling elements according to the invention are preferably in the form of rods and/or pins.

The decoupling elements according to the invention can in this case be arranged, for example, between two radiating elements, for example between two or more vertically polarized or horizontally polarized radiating elements, in each case in the region of the connecting line between these radiating elements.

In the case of cruciform dipoles, for example, the decoupling elements according to the invention, which are preferably seated perpendicular on the reflector plate, can be arranged in the immediate area between the individual dipole halves, for example, in plan view, on an angle bisector of a cruciform dipole arrangement.

One or more of the decoupling elements according to the invention can likewise, for example in the case of a dipole square, be arranged within the dipole square, and in this case once again preferably on an angle bisector of the dipole square.

The decoupling elements, which are in the form of rods according to the invention, extend as stated with their greatest longitudinal extent or component in the propagation direction of the magnetic waves and/or at right angles to the reflector plane. In this case, the decoupling elements may have a uniform cross section or widely differing cross-sectional shapes, for example with a round cross section or with a regular cross section or an irregular n-polygonal, for example square or hexagonal cross section, etc.

However, the cross section may in this case also vary over the length of the decoupling elements according to the invention. It is likewise possible for the cross-sectional areas not to be rotationally symmetrical but, for example, to have different longitudinal extents along two mutually perpendicular section axes running parallel to the reflector surface.

Finally, it is also possible for the decoupling elements according to the invention also to be provided, in particular at their end opposite the reflector plate, with formed-out regions or fixtures, which may also extend transversely with respect to the vertical extent component of the decoupling element, and hence transversely with respect to the propagation direction of the electromagnetic waves and/or parallel to the plane of the reflector plate.

The invention will be explained in more detail in the following text with reference to exemplary embodiments. In this case, in detail:

FIG. 1*a* shows a schematic plan view of two dipoles, which are arranged offset with respect to one another in the vertical fitting direction, and with a decoupling element according to the invention seated between them.

FIG. 1*b* shows a schematic side view of the exemplary embodiment shown in FIG. 1*a*, along the arrow 2 in FIG. 1;

Figure 3:
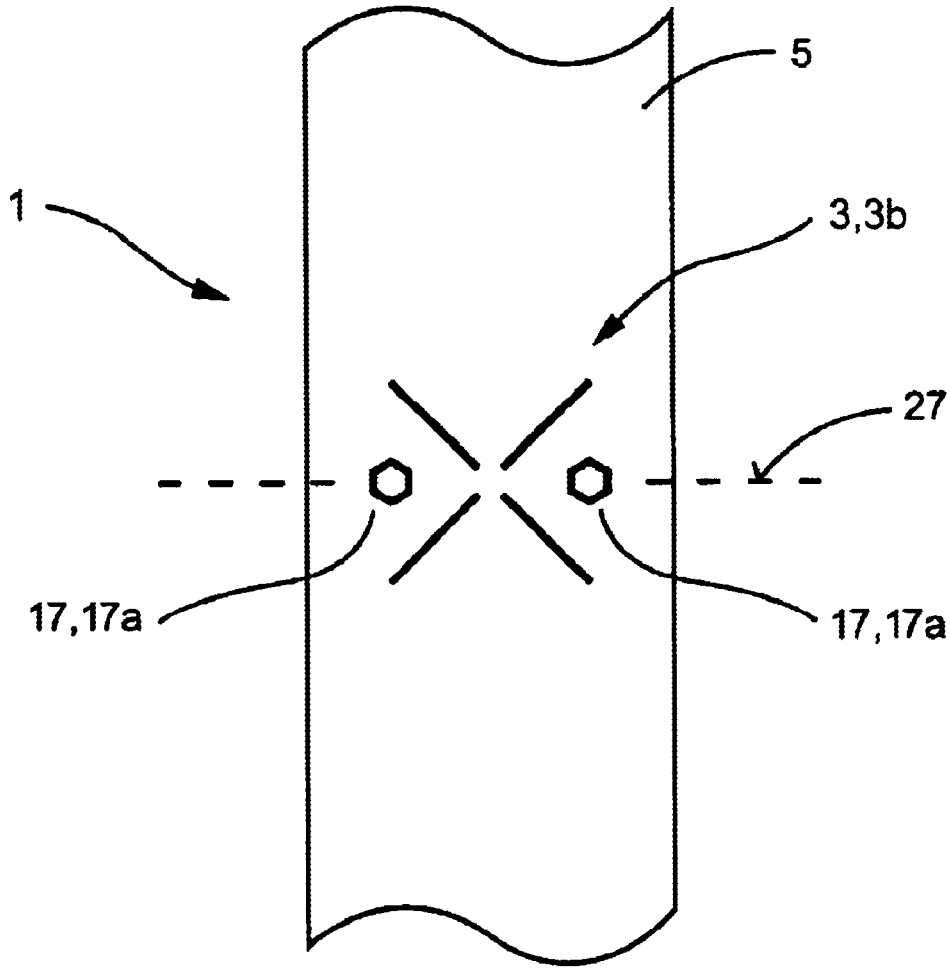
FIG. 3 shows a further modified exemplary embodiment of the invention, based on a cruciform dipole.
Figure 3A:
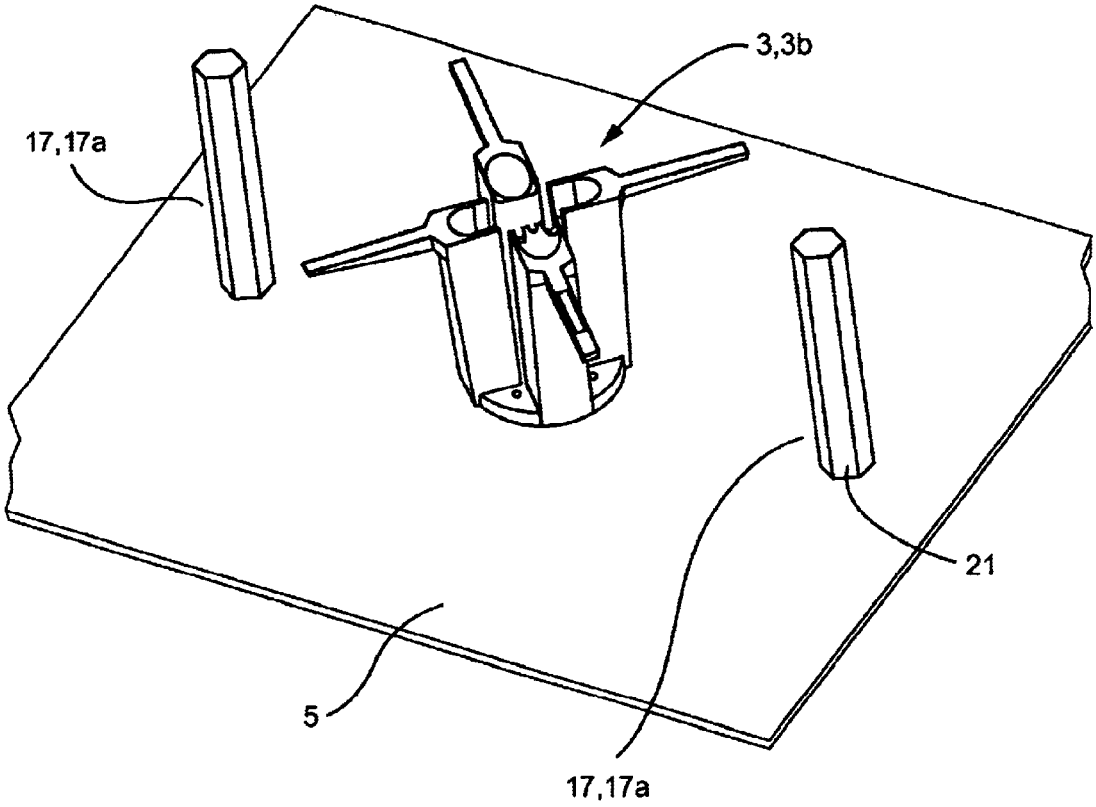
Figure 3B:
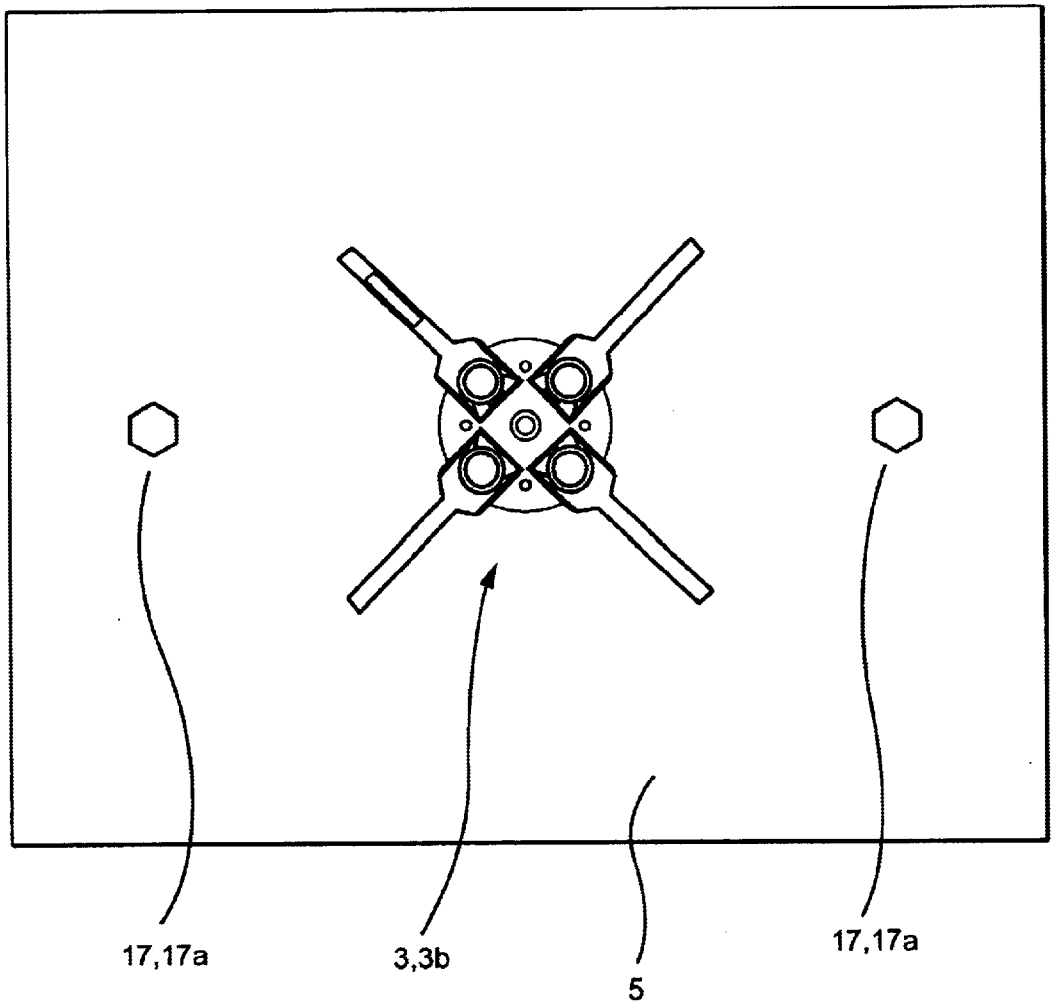
Figure 3C:
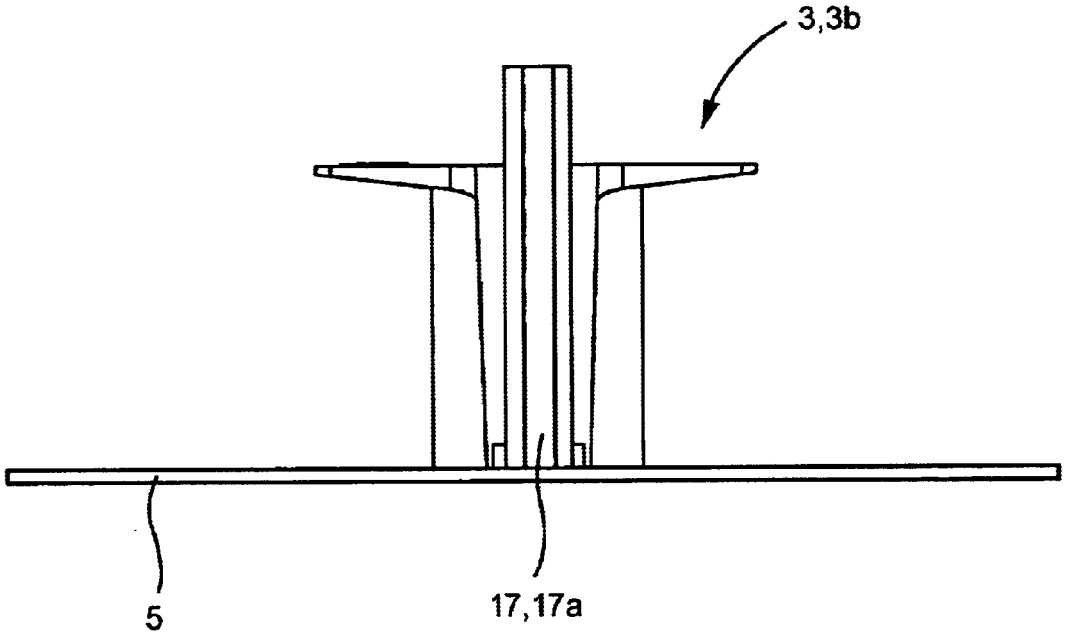
Figure 4:
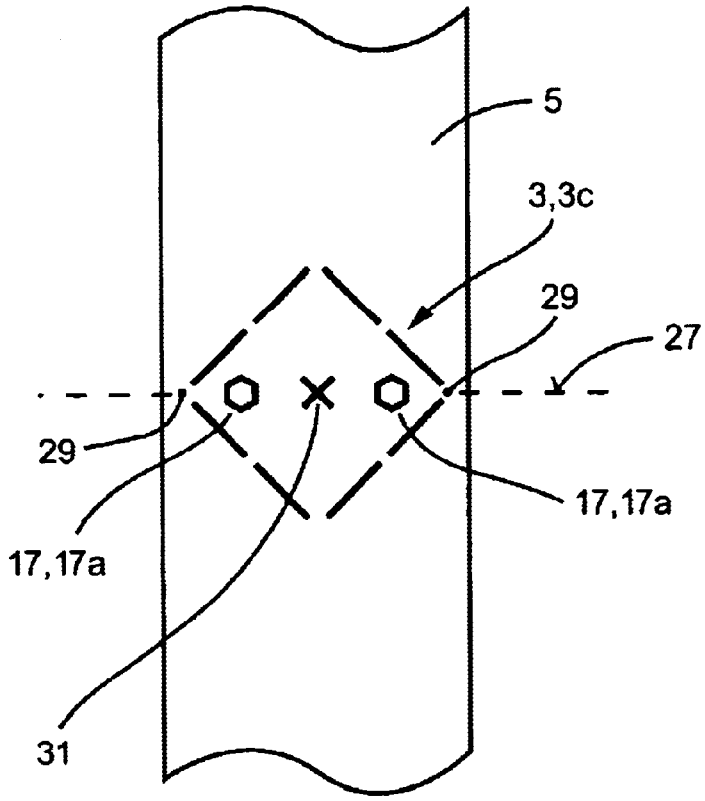
Figure 5:
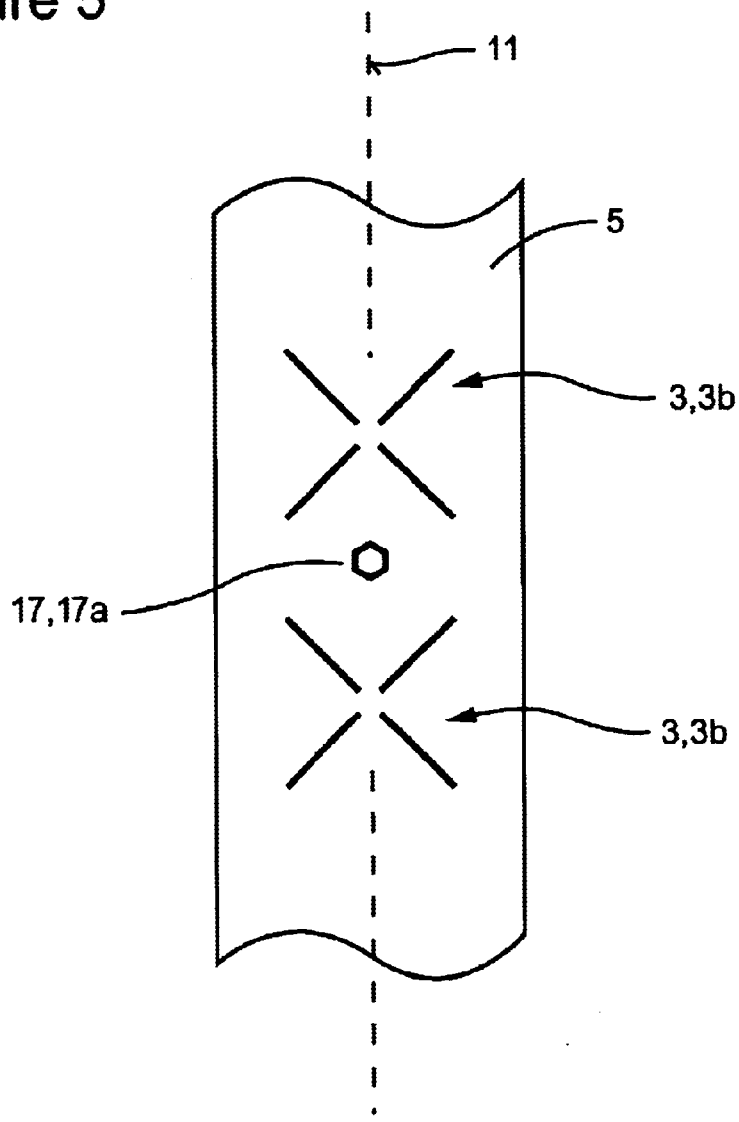
Figure 6:
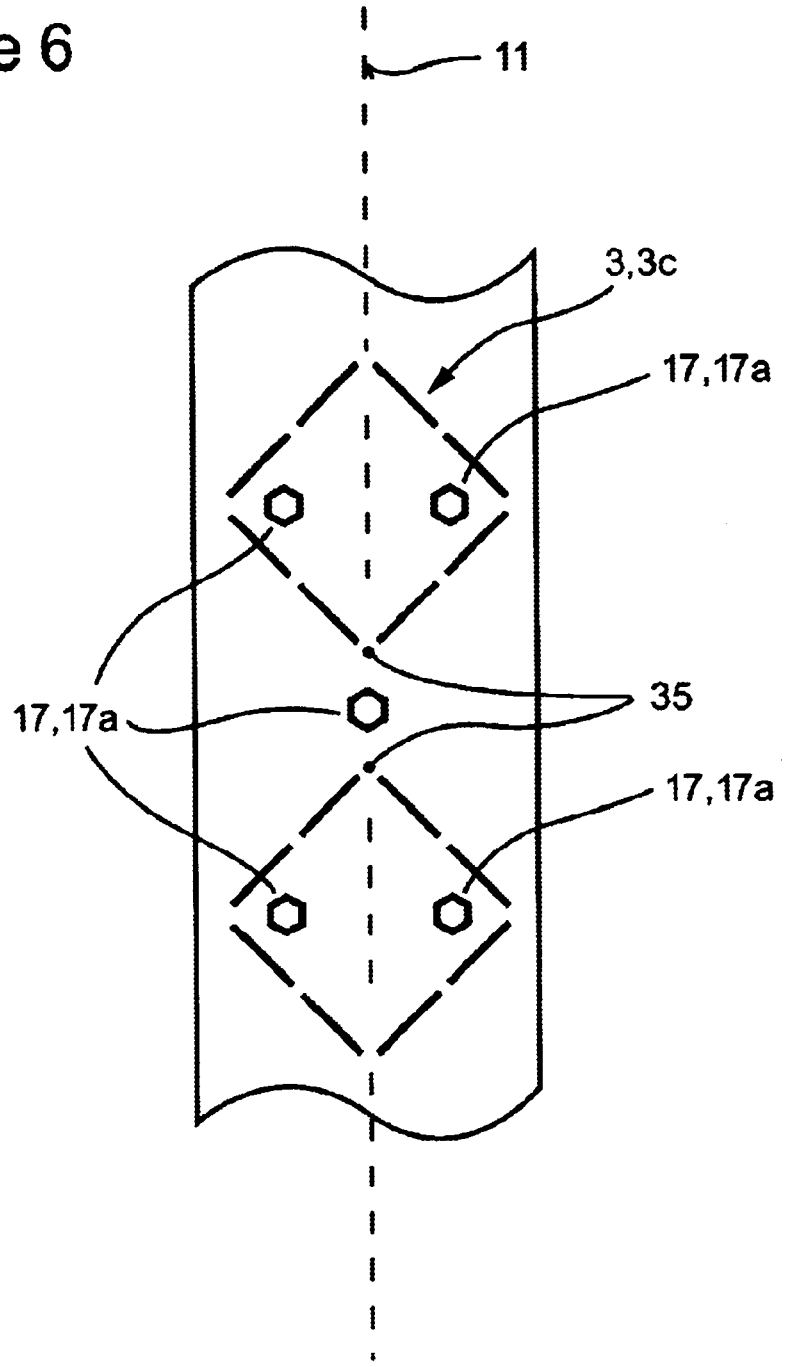

FIG. 3*a* shows a perspective illustration of the exemplary embodiment shown in FIG. 3;

FIG. 3*b* shows a plan view of the exemplary embodiment shown in FIG. 3;

FIG. 3*c* shows a schematic side view of the exemplary embodiment shown in FIGS. 3 to 3*b*, along the arrow 2 in FIG. 3, FIG. 4 shows a modified exemplary embodiment of the invention, for the case of a dipole square;

FIG. 5 shows an antenna according to the invention having two cruciform dipoles arranged offset with respect to one another;

FIG. 6 shows a further exemplary embodiment of the invention, based on two dipole squares arranged offset with respect to one another;

FIGS. 7 to 10 show different side views of different embodiments of a decoupling element.

Figure 1A:
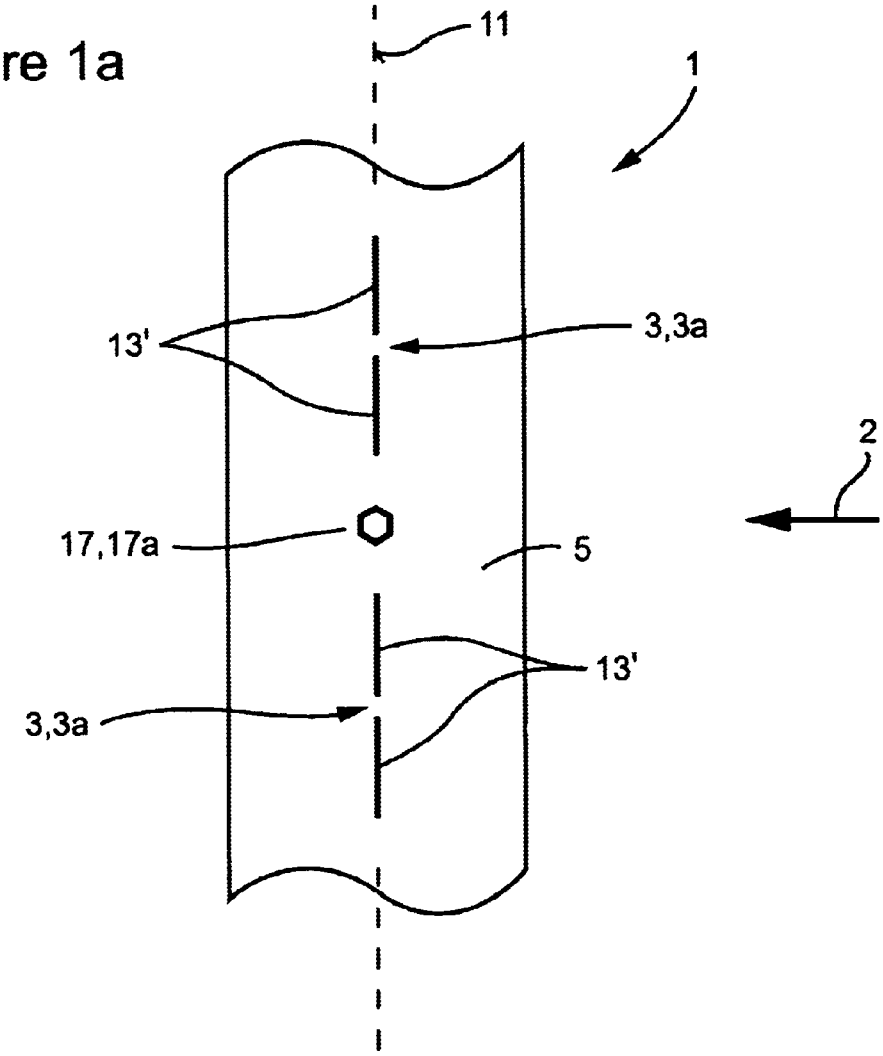
Figure 1B:
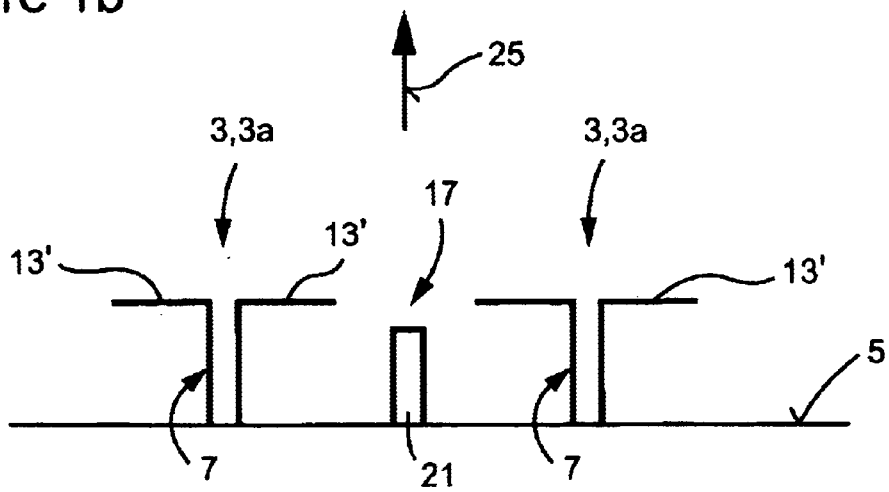

The following text refers to FIGS. 1*a* and 1*b* which show, in a schematic plan view, an antenna 1 having at least two radiating elements 3, namely composed of two dipole radiating elements 3*a*, each having two dipole halves 13', which, according to the exemplary embodiment shown in FIG. 1, are arranged at an appropriate suitable distance in front of a reflector 5 or a reflector plate 5. The schematic side view illustrated in FIG. 1*b* shows the respectively associated balancing elements 7, via which the dipole halves 13' are held with respect to the reflector plate 5.

The dipole radiating elements 3*a* are arranged, with their dipole halves 13', offset with respect to one another on a fitting line 11 in the illustrated exemplary embodiment.

A decoupling element 17 according to the invention is arranged between the two radiating elements 3, parallel to the propagation direction of the electromagnetic wave (that is to say, if the far field is considered, at right angles to the plane under consideration or the plane of the drawing), that is to say at the same time also at right angles to the plane of the reflector 5, in the illustrated exemplary embodiment and, in the illustrated exemplary embodiment, this decoupling element 17 comprises a decoupling element 17*a* which is in the form of a rod and has a hexagonal cross section, that is to say is formed like a regular hexagon.

The decoupling element 17 or 17*a* formed in this way is conductively connected at its base 21 to the reflector 5, for example being electrically conductively connected or capacitively connected to it.

The length of the element in the form of a rod, that is to say its extent direction parallel to the propagation direction of the electromagnetic waves of the antenna 1 formed in this way, that is to say at right angles to the reflector 5, is preferably 0.05 times the wavelength to the wavelength of the antenna frequency band to be transmitted.

The diameter of the element in the form of a rod can likewise differ within wide ranges, and is preferably approximately 0.01 to 0.2 times the wavelengths to be transmitted.

Figure 2:
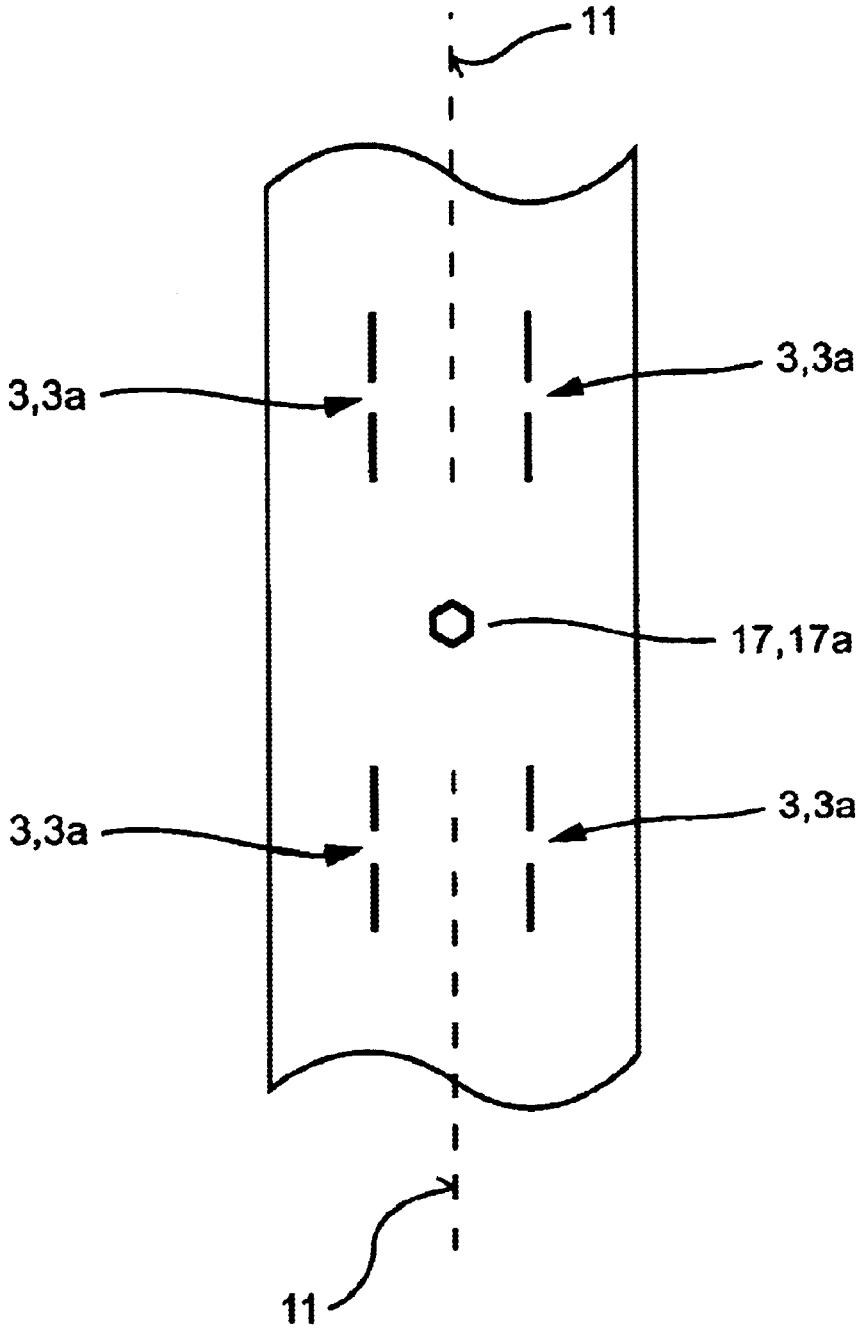
FIG. 2 shows a plan view of a modified exemplary embodiment of an antenna.

FIG. 2 will be used to show that a corresponding decoupling element 17, 17*a* can be provided between two radiating elements which are different to those shown in FIG. 1. FIG. 2 in each case shows two dipole radiating elements, which are each seated in pairs, aligned parallel, above and below the decoupling element. FIG. 2 shows a side view according to the arrow 2, relating to the exemplary embodiment shown in FIG. 1*b*.

The exemplary embodiment as illustrated in FIG. 3 and the further FIGS. 3*a* to 3*c* shows an antenna 1 which comprises two dipole radiating elements joined together to form a cruciform dipole 3*b*. A corresponding decoupling element 17, 17*a* is in each case arranged lying on an angle bisector 27 of the dipole radiating elements, which are arranged in a cruciform shape in plan view, in the region of the cruciform dipole 3*b*. This is thus a dual-polarized antenna arrangement with a cruciform dipole, in which case it is particularly surprising that the decoupling principle operates just with a cruciform dipole such as this. As is known in principle in the case of cruciform dipoles (or, for example, dipole squares), two separate inputs are thus used for actuation, between which decoupling (or isolation) is measurable, in which case the use of the decoupling device according to the invention can in this way be verified. In this case, it is furthermore surprising that the principle of the decoupling elements according to the invention also operates when an asymmetric arrangement is used, that is to say, for example in FIGS. 3 to 3*c*, only one of the two decoupling elements is used.

The exemplary embodiment in FIG. 4 shows a plan view of a dipole square 3*c* at an appropriate distance in front of a reflector 5, with two decoupling elements 17, 17*a* being shown lying on an angle bisector 27 in the region of the cruciform dipole 3*c*, and each lying in a region between the corner points 29 of the dipole square and the center point 31 of the dipole square.

The exemplary embodiment in FIG. 5 shows two radiating element devices arranged vertically one above the other, in the form of two cruciform radiating elements 36 in front of a vertically running reflector 5, with a decoupling element 17, 17*a* according to the invention being shown centrally on the vertical fitting line or connecting line 11, and likewise once again extending parallel to the propagation direction of the electromagnetic waves of the radiating elements, in other words at right angles to the plane of the reflector 5.

In the exemplary embodiment shown in FIG. 6, two dipole squares 3, 3*c*, which are illustrated with reference to FIG. 4, are arranged in the vertical gap along a vertical connecting axis 11 in front of a reflector 5, to be precise in each case with two decoupling elements 17, 17*a*, located in a corresponding manner within the dipole square, and explained with reference to FIG. 4. In addition, a fifth decoupling element, which is in the form of a rod and is seated at right angles to the reflector 5, is shown, along the vertical connecting line 11 in the illustrated exemplary embodiment, centrally between the two corner points 35, which point toward one another, of the dipole squares 3*c* formed in this way.

The fundamental design of the antenna device, and the use of corresponding decoupling elements 17, 17*a* has been described for various antenna types. A number of further modifications of antennas, that is to say in particular other antenna types and the design and arrangement of different radiating elements are also feasible here, as required, in which all of the explained decoupling elements 17, 17*a* can be used.

In contrast to the illustrated exemplary embodiments, the decoupling elements 17, 17*a* may also be shaped differently within wide ranges, and, in particular, they may also be provided with a different cross section. The cross section of the decoupling elements 17, 17*a* may, for example, be n-polygonal, round, elliptical, with partially convex and concave successive circumferential sections, or else may be designed in some other way, with the entire longitudinal extent of the decoupling element 17, 17*a* formed in this way, or its extent component at right angles to the reflector 5 and/or parallel to the propagation direction of the electromagnetic waves of the antenna 1 being of a size which is larger than the cross-sectional size in any desired transverse direction parallel to the plane of the reflector 5. The cross-sectional shape transversely with respect to the extent direction or parallel to the reflector 5 may thus vary over the length of the decoupling element 17, 17*a* not only from its extent size, but also from that shape. In particular, at the end of the decoupling element 17, 17*a* located at the top, that is to say opposite its base 21 which is seated on the reflector 5, further structural elements may also be provided, for example conical or spherical fixtures, or asymmetric attachments, attachments in the form of bars, etc. with these attachments having a size in the direction parallel to the reflector 5 or transversely with respect to the propagation direction of the electromagnetic waves which is shorter than the extent component in the propagation direction of the electromagnetic waves, that is to say at right angles to the reflector 5.

The main extent direction 25 (FIG. 1*a*) of the decoupling element 17 according to the invention is thus provided in an angle range of more than 45° with respect to the plane of the reflector 5 up to preferably 90°, that is to say running at right angles to the plane of the reflector 5.

Figure 7:
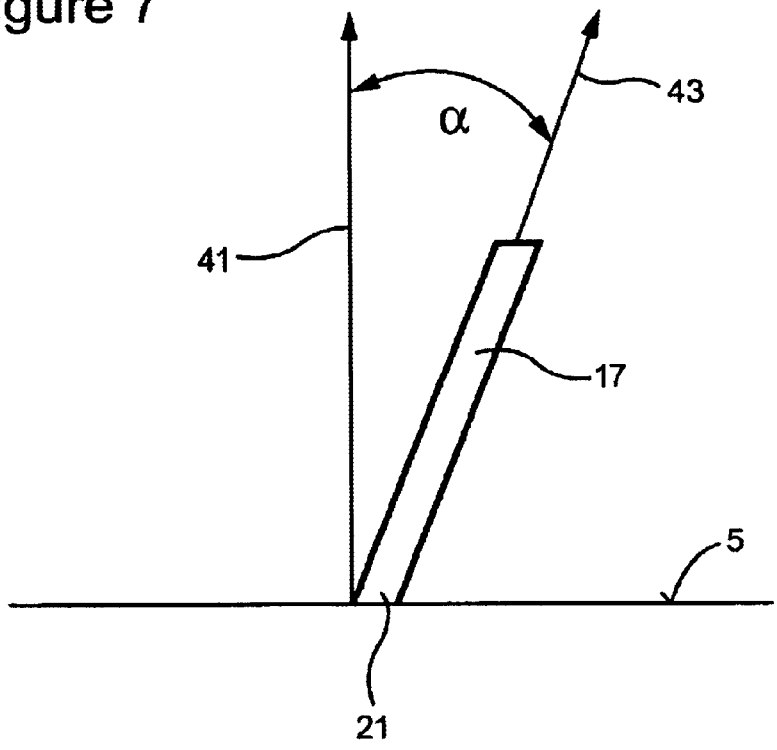

Further variation options with regard to the decoupling elements 17 are shown in FIG. 7. FIG. 7 in this case shows a cross-sectional illustration of the reflector plane 5, and of a decoupling element 17 which is seated on it and which, as explained, may also be arranged obliquely, that is to say not at right angles to the plane of the reflector plate 5. The angle a, that is to say the angle α formed by the perpendicular 41 to the plane of the reflector 5 with respect to the extent direction 43 of the decoupling element 17, is in this case less than 45°, preferably less than 30° or 150, and preferably just 0°. The normal 41 to the plane of the reflector 5 in this case corresponds, considering the far field, to the propagation direction of the electromagnetic waves.

Figure 8:
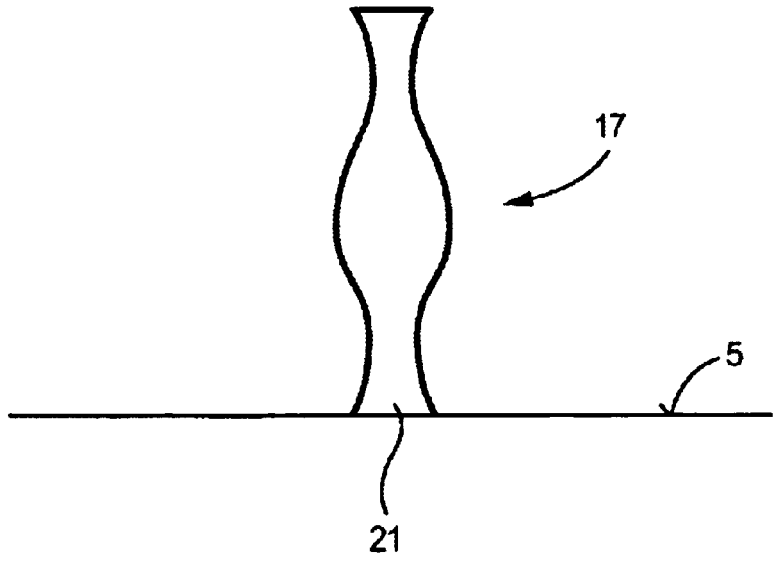

FIG. 8 shows that the decoupling element may also have different cross-sectional shapes and sizes along its longitudinal extent.

Figure 9:
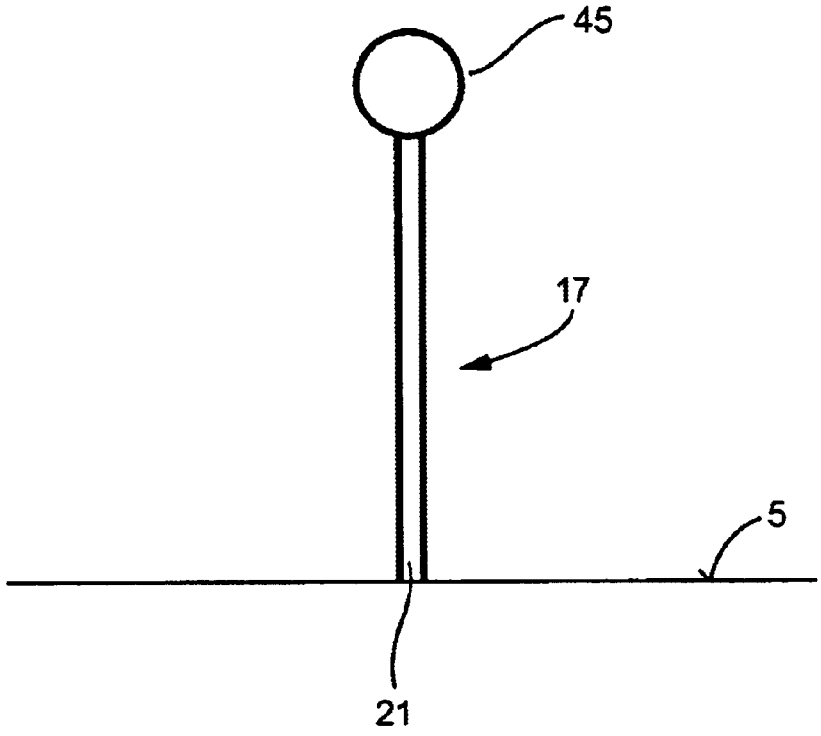

FIG. 9 shows that fixtures or attachments 45 can be formed on the coupling element, in particular at the upper end of the decoupling element 17, which also project beyond the external size of that part of the decoupling element 17 which is located underneath. FIG. 9 shows, for example, a spherical fixture.

Figure 10:
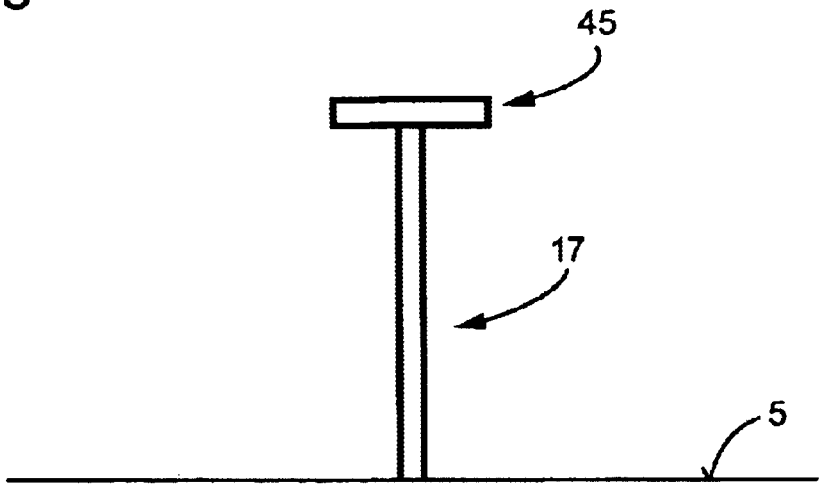

In contrast, FIG. 10 shows a short fixture 45 in the form of a rod, whose maximum transverse extent is, however, less than the total height of the decoupling element 17.

Any desired further modifications are to this extent feasible within the scope of the idea of the invention.

What is claimed is:

1. An antenna comprising:

a reflector;

at least one dual-polarized radiating element arranged in front of the reflector and exhibiting a main electromagnetic wave propagation direction, the element having at least one associated passive conductive decoupling element, the decoupling element having a longest extent in one direction, thus defining its main extent direction, the main extent direction of the decoupling element being at least one of (a) parallel to the main propagation direction of the electromagnetic wave, when considered in the far field, or (b) at right angles to the plane of the reflector or (c) includes an angle (α), which is less than 45°, when considered in the far field, with at least one of (1) the main propagation direction of the electromagnetic wave, and (2) with a perpendicular to the plane of the reflectors.

2. The antenna as claimed in claim 1, wherein the decoupling element has a base which is electrically conductively connected to the reflectors.

3. The antenna as claimed in claim 1, wherein the decoupling element has a base which is capacitively connected to the reflector.

4. The antenna as claimed in claim 1, wherein the length of the decoupling element or the projection of the length of the decoupling element onto the main propagation direction of the electromagnetic wave which is produced when considered in the far field, or the perpendicular to the plane of the reflector is greater than 0.05 times the wavelength of the electromagnetic waves transmitted of received via the radiating elements.

5. The antenna as claimed in claim 1, wherein the extent length of the decoupling element or its component in the propagation direction of the electromagnetic waves, when considered in the far field, or at right angles to the plane of the reflector is less than the wavelength of the electromagnetic waves transmitted or received via the radiating elements .

6. The antenna as claimed in claim 1, wherein the thickness of the decoupling element is greater than 0.01 times the operating wavelength.

7. The antenna as claimed in claim 1, wherein the thickness of the decoupling element is less than 0.2 times the operating wavelength.

8. The antenna as claimed in claim 1, wherein the cross section transversely with respect to the extent direction of the decoupling element is n-polygonal, round, elliptical or irregular.

9. The antenna as claimed in claim 1, wherein the angle ($\alpha$) between the extent direction in the longitudinal direction of the decoupling element and the main propagation direction of the electromagnetic waves, which is produced when considered in the far field, or the normal to the plane of the reflector is less than 30°, preferably less than 15°, and in particular is around 0°.

10. The antenna as claimed in claim 1, wherein the decoupling element has a base and is provided, in particular at an end opposite the base, with an attachment or fixture which projects beyond the cross-sectional size of that section of the decoupling element which is located underneath.

11. The antenna as claimed in claim 10, wherein the attachment or fixture is least one of (a) spherical, (b) polygonal, or (c) in the form of a rod.

12. The antenna as claimed in claim 1, wherein the decoupling element is in the form of a rod, a strip or a waveguide.

13. The antenna as claimed in claim 1, wherein the at least two radiating elements are provided, and in that the at least one decoupling element is arranged between two adjacent radiating elements.

14. The antenna as claimed in claim 13, wherein the at least one decoupling element is arranged on the connection line (11) between two adjacent radiating elements, preferably centrally between them.

15. The antenna as claimed in claim 1, wherein, in the case of a cruciform dipole, at least one, and preferably at least two, decoupling elements are arranged in the region of the cruciform dipole.

16. The antenna as claimed in claim 1, wherein, in the case of a dipole square, at least one, and preferably at least two, decoupling elements are arranged in the region of the dipole square.

17. The antenna as claimed in claim 15, wherein the at least one decoupling elements is arranged on an angle bisector.

18. The antenna as claimed in claim 15, wherein the at least one, and preferably the at least two, decoupling element is arranged on the angle bisector between the center point of the radiating element and in front of its outer boundary.

19. The antenna as claimed in claim 1, wherein the radiating elements comprise dipole radiating elements for transmitting vertical polarizations, horizontal polarizations, or orthogonal polarizations.

20. The antenna as claimed in claim 1, wherein the antenna including the at least one coupling element, is asymmetric.

21. The antenna as claimed in claim 1, wherein further including at least two separate inputs that are measurably decoupled from one another.

22. The antenna as claimed in claim 1, wherein including plural identically-designed decoupling elements.

23. The antenna as claimed in claim 1, wherein a number of decoupling elements are provided, said number of decoupling elements being designed differently.

24. An antenna comprising:

a planar reflector;

at least one dual-polarized radiating element disposed in front of the reflector, said radiating element exhibiting a main electromagnetic propagation direction; and at least one passive conducting decoupling element disposed on and coupled to said reflector, said decoupling element comprising a rod having a longitudinal extent and a width extent, the longitudinal extent being greater than the width extent, the angle between the rod's longitudinal extent and a perpendicular to the plane of the planar reflector being less than 45 degrees when considered in the far field.

25. An antenna comprising:

a planar reflector;

at least one dual-polarized radiating element disposed in front of the reflector, said radiating element exhibiting a main electromagnetic propagation direction; and at least one passive conducting decoupling element disposed on and coupled to said reflector, said decoupling element comprising a rod having a longitudinal extent and a width extent, the longitudinal extent being greater than the width extent, the angle between the rod's longitudinal extent and the main propagation direction exhibited by the radiating element being less than 45 degrees when considered in the far field.

26. An antenna comprising:

a planar reflector, at least one dual-polarized radiating element disposed in front of the reflector, said radiating element exhibiting a main electromagnetic propagation direction; and at least one passive conducting decoupling element disposed on and coupled to said reflector, said decoupling element comprising a rod having a longitudinal extent and a width extent, the longitudinal extent being greater than the width extent, the rod's longitudinal extent being parallel to said main propagation direction, when considered in the far field.

27. An antenna comprising:

a planar reflector;

at least one dual-polarized radiating element disposed in front of the reflector, said radiating element exhibiting a main electromagnetic propagation direction; and at least one passive conducting decoupling element disposed on and coupled to said reflector, said decoupling element comprising a rod having a longitudinal extent and a width extent, the longitudinal extent being greater than the width extent, the rod's longitudinal extent being at right angles to the plane of the reflector.

* * * * *

UNITED STATES PATENT AND TRADEMARK OFFICE

CERTIFICATE OF CORRECTION

PATENT NO. : 6,734,829 B1
DATED : May 11, 2004
INVENTOR(S) : Gottl, M.

It is certified that error appears in the above-identified patent and that said Letters Patent is hereby corrected as shown below:

Title page,
Item [22], PCT filed, should read -- July 6, 2000 --

Signed and Sealed this

Thirteenth Day of July, 2004

JON W. DUDAS
*Acting Director of the United States Patent and Trademark Office*